US006845137B2

(12) United States Patent
Ruth et al.

(10) Patent No.: US 6,845,137 B2
(45) Date of Patent: Jan. 18, 2005

(54) SYSTEM AND METHOD FOR THE PRODUCTION OF 18F-FLUORIDE

(75) Inventors: Thomas J. Ruth, Vancouver (CA); Kenneth R. Buckley, Vancouver (CA); Kwonsoo Chun, Inchun (KR); Salma Jivan, Delta (CA); Stefan K. Zeisler, Vancouver (CA)

(73) Assignee: Triumf, Vancouver (CA)

( * ) Notice: Subject to any disclaimer, the term of this patent is extended or adjusted under 35 U.S.C. 154(b) by 0 days.

(21) Appl. No.: 09/790,572

(22) Filed: Feb. 23, 2001

(65) Prior Publication Data

US 2001/0043663 A1 Nov. 22, 2001

Related U.S. Application Data

(60) Provisional application No. 60/184,352, filed on Feb. 23, 2000.

(51) Int. Cl.[7] ..... G21G 1/10
(52) U.S. Cl. ..... 376/195; 376/194; 376/156
(58) Field of Search ..... 376/195, 194, 376/156

(56) References Cited

U.S. PATENT DOCUMENTS

| | | | | |
|---|---|---|---|---|
| 4,622,201 A | | 11/1986 | Robertson et al. | |
| 4,794,178 A | | 12/1988 | Coenen et al. | |
| 5,280,505 A | * | 1/1994 | Hughey et al. | 376/156 |
| 5,425,063 A | | 6/1995 | Ferrieri et al. | |
| 5,917,874 A | * | 6/1999 | Schlyer et al. | 376/194 |

OTHER PUBLICATIONS

Dahl et al., "Production of radio–isotopes at North Shore Univesity Hospital," Nuclear Instruments and Methods in Physics Research B 99 (1995), p. 817–820.*

Merriam–Webster's Collegiate Dictionary, Tenth Edition, p. 190.*

Nickles et al., "Production of Reactive Fluorine–18," Appl. Radiat. Isot., vol. 37, No. 8, pp. 649–661, 1986.*

Firouzbakht et al., A Cryogenic Solid Target for the Production of Fluorine 18 (Fluoride) from Oxygen–18 (Carbon Dioxide), Appl. Radiat. Isot., vol. 44, No. 8, pp. 1081–1084, 1993.*

Lindner et al., "A dynamic Loop Target for the In–Cyclotron Production of Fluorine 18 . . . ", Appl. Radiat. Isot., vol. 24, No. 8, pp. 124–126, 1973.*

Tilbury et al., "Fluorine–18 Production for Medical Use by Helium–3 Bombardment of Water," Appl. Radiat. Isot., vol. 21, pp. 277–281, 1970.*

VanBrocklin et al., "High Pressure H2–18O Target for the Production of 18F–Fluoride ion," Chemists' Views of Imaging Centers, Plenum Press, NY, 1995.*

T.J. Ruth et al., "Targetry for the Production of Ultra High Quantities of 18F–Fluoride: A work in Progress", abstract from 8$^{th}$ Workshop on Targetry and Target Chemistry (1999); www.triumf.ca/wtta/pdf/1999/p41.pdf.

N. Satyamurthy, "Oxygen Gas Target System for the Production of Reactive No–Carrier–Added 19F–Fluoride Ion", Journal of Nuclear Medicine, vol. 5, p. 18p, abstr No. 65 (May 2001).

(List continued on next page.)

*Primary Examiner*—Jack Keith
*Assistant Examiner*—Rick Palabrica
(74) *Attorney, Agent, or Firm*—Harness Dickey

(57) ABSTRACT

A system and method for producing $^{18}$F-Fluoride by using a proton beam to irradiate $^{18}$Oxygen in gaseous form. The irradiated $^{18}$Oxygen is contained in a chamber that includes at least one component to which the produced $^{18}$F-Fluoride adheres. A solvent dissolves the produced $^{18}$F-Fluoride off of the at least one component while it is in the chamber. The solvent is then processed to obtain the $^{18}$F-Fluoride.

19 Claims, 2 Drawing Sheets

OTHER PUBLICATIONS

Pinto, et al., "Target Systems for Radioisotope Production" IEEE Transactions on Nuclear Science, vol. NS–30, No. 2, pp. 1797–1800, Apr. 1983.

Nickles, et al., "An $^{18}O_2$–Target for the High Yield Production of $^{18}F$–Fluoride", International Journal of Applied Radiation and Isotopes, vol. 34, No. 3, pp. 625–629, Mar. 1983.

Nickles, et al., An $^{18}O_2$ Target for the Production of $[^{18}F]F_2$, International Journal of Applied Radiation and Isotopes, vol. 35, No. 2, pp. 117–122, Feb. 1984.

Iwata Ren, "Target Box for Simultaneous Production of 13NH+4 and 18F", Publication No. 04077699 dated Mar. 11, 1992 (Japanese Abstract only).

Vandecasteele, et al., "Routine Production of . . . Reaction", Radiochem. Radioanal. Letters 46/5 pp. 285–290, 19981.

Schlyer, et al., "Separation of . . . Exchange Resin", Appl. Radial. Isot. vol. 41, No. 6, pp. 531–533, 1990.

Brinkman, "Isotope Production . . . Proton Beams", International Journal of Applied Radiation and Isotopes, vol. 31, pp. 85–91, 1980.

Bechtold, et al., "Radioisotope für die medizinische Diagnostik", Nachrichten—Forschungazentrum Kartsruhe Jahrg. 32, Jan. 2, 2000 pp. 10–14.

Adilbish, et al., "$^{123}I$ Production from . . . Medical Research", International Journal of Applied Radiation and Isotopes, vol. 31, pp. 163–167, 1980.

Chemical Abstracts, vol. 95, 1981; 95: 177334z.

Roberts, et al., "A reevaluation of . . . MeV protons", Submitted to Applied Radiation and Isotopes, Oct. 5, 1995.

Jewett, et al., "Extraction of . . . Exchange Resin", Applied Radiation Isotopes, vol. 41, No. 6, pp. 583–586, 1990.

Ruth, et al., "Absolute Cross . . . Reaction", Radiochimica Acta 26, pp. 21–24, 1979.

Casella, et al., "Anhydrous F–18 . . . Preparation", The Journal of Nuclear Medicine 21: pp. 750–757, 1980.

Ehrenkaufer, et al., "Production of $H^{18}$ . . . Gas Target", Radiochimica Acta 33, pp. 49–56, 1983.

Kilbourn, et al., "A Smple $^{18}O$ . . . Production", International Journal Applied Radiation and Isotopes, vol. 35, No. 7, pp. 599–602, 1984.

Kilbourn, et al., "An Improved . . . Production", International Journal Applied Radiation and Isotopes, vol. 36, No. 4, pp. 327–328, 1985.

Tewson, et al., "Routine Production . . . Water Target", Nucl. Med. Biol., vol. 15, No. 5, pp. 499–504, 1988.

Steinbach, et al., "Temperature Course . . . Production", Applied Radiation Isotopes, vol. 41, No. 8, pp. 753–756, 1990.

Vogt, et al., "Improved Production . . . Nucleophilic Syntheses", Applied Radiation Isotopes, vol. 37, No. 5, pp. 448–449, 1986.

Keinonen, et al., "Effective Small–Volume . . . Fluoride", Applied Radiation Isotopes, vol. 37, No. 7, pp. 631–632, 1986.

Iwata, et al., "$[^{18}F]$Fluoride Production . . . Target", Applied Radiation Isotopes, vol. 38, No. 11, pp 979–984, 1987.

Nickles, et al., An $^{18}O_2$ Target for the Production of $[^{18}F]F_2$, International Journal Applied Radiation and Isotopes, vol. 35, No. 2, pp. 117–122, 1984.

Roberts, et al., Development of an improved target for $[^{18}F]F_2$ production, Applied Radiation Isotopes, pp. 1–22, received Aug. 10, 1994.

Steyn, et al., "A Novel Krypton . . . generators", pp. 104–111.

Hamacher, et al., "Efficient Stereospecific . . . Nucleophilic Substitution", Journal of Nuclear Medicine, vol. 27, No. 2, pp. 235–238, 1986.

Blessing, et al., "Production of . . . Process", Applied Radiation Isotopes, vol. 37, No. 11, pp. 1135–1139, 1986.

"A Diagnostic Study of Proton–beam Irradiated Water Targets", Heselius et al., *Applied Radiation and Isotopes*, vol. 40, No. 8 pp. 663–669, 1989.

"A Water Target With Beam Sweet for Routine Fluorine–18 Production", H.J. Helmeke et al., *Applied Radiation and Isotopes*, vol. 54, pp. 753–759, 2001.

"Production of Reactive Fluorine–18", R. Nickles et al., *Applied Radiation and Isotopes*, vol. 37, No. 8, pp. 649–661, 1986.

* cited by examiner

SYSTEM AND METHOD FOR THE PRODUCTION OF 18F-FLUORIDE

CROSS REFERENCE TO RELATED APPLICATION

This application claims priority under 35 U.S.C. §119 (e) of U.S. Provisional application 60/184,352 filed Feb. 23, 2000, the entire contents of which are specifically incorporated herein by reference.

FIELD OF THE INVENTION

The present invention relates to a technique for producing $^{18}$F-Fluoride from $^{18}$O gas.

BACKGROUND OF THE INVENTION

Many medical procedures diagnosing the nature of biological tissues, and the functioning of organs including these tissues, require radiation sources that are introduced into, or ingested by, the tissue. Such radiation sources preferably have a half-life of few hours—neither long enough for the radiation to damage the tissue nor short enough for radiation intensity to decay before completing the diagnosis. Such radiation sources are preferably not chemically poisonous. $^{18}$F-Fluoride is such a radiation source.

$^{18}$F-Fluoride has a lifetime of about 109.8 minutes and is not chemically poisonous in tracer quantities. It has, therefore, many uses in forming medical and radiopharmaceutical products. The $^{18}$F-Fluoride isotope can be used in labeling compounds via the nucleophilic fluorination route. One important use is the forming of radiation tracer compounds for use in medical Positron Emission Tomography (PET) imaging. Fluoro-deoxyglucose (FDG) is an example of a radiation tracer compound incorporating $^{18}$F-Fluoride. In addition to FDG, compounds suitable for labeling with $^{18}$F-Fluoride include, but are not limited to, Fluorothymidine (FLT), fluoro analogs of fatty acids, fluoro analogs of hormones, linking agents for labeling peptides, DNA, oligo-nucleotides, proteins, and amino acids.

Several nuclear reactions, induced through irradiation of nuclear beams (including protons, deuterons, alpha particles, . . . etc), produce the isotope $^{18}$F-Fluoride. $^{18}$F-Fluoride forming nuclear reactions include, but are not limited to, $^{20}$Ne(d,$\alpha$)$^{18}$F (a notation representing a $^{20}$Ne absorbing a deuteron resulting in $^{18}$F and an emitted alpha particle), $^{16}$O($\alpha$,pn)$^{18}$F, $^{16}$O($^{3}$H,n)$^{18}$F, $^{16}$O($^{3}$H,p)$^{18}$F, and $^{18}$O(p,n)$^{18}$F; with the greatest yield of 18F production being obtained by the $^{18}$O(p,n)$^{18}$F because it has the largest cross-section. Several elements and compounds (including Neon, water, and Oxygen) are used as the initial material in obtaining $^{18}$F-Fluoride through nuclear reactions.

Technical and economic considerations are critical factors in choosing an $^{18}$F-Fluoride producing system. Because the half-life of $^{18}$F-Fluoride is about 109.8 minutes, $^{18}$F-Fluoride producers prefer nuclear reactions that have a high cross-section (i.e., having high efficiency of isotope production) to quickly produce large quantities of $^{18}$F-Fluoride. Because the half-life of $^{18}$F-Fluoride is about 109.8 minutes, moreover, users of $^{18}$F-Fluoride prefer to have an $^{18}$F-Fluoride producing facility near their facilities so as to avoid losing a significant fraction of the produced isotope during transportation. Progress in accelerator design has made available sources of proton beams having higher energy and currents.

Systems that produce proton beams are less complex, as well as simpler to operate and maintain, than systems that produce other types of beams. Technical and economic considerations, therefore, drive users to prefer $^{18}$F-Fluoride producing systems that use proton beams and that use as much of the power output available in the proton beams. Economic considerations also drive users to efficiently use and conserve the expensive startup compounds.

However, inherent characteristics of $^{18}$F-Fluoride and the technical difficulties in implementing $^{18}$F-Fluoride production systems have hindered reducing the cost of preparing $^{18}$F-Fluoride. Existing approaches that use Neon as the startup material suffer from problems of inherent low nuclear reaction yield and complexity of the irradiation facility. The yield from Neon reactions is about half the yield from $^{18}$O(p,n)$^{18}$F. Moreover, using Neon as the startup material requires facilities that produce deuteron beams, which are more complex than facilities that produce proton beam.

Using Neon as the start-up material, therefore, has resulted in low $^{18}$F-Fluoride production yield at a high cost.

Existing approaches that use $^{18}$O-enriched water as the startup material suffer from problems of recovery of the unused $^{18}$O-enriched water and of the limited beam intensity (energy and current) handling capability of water. Using $^{18}$O-enriched water suffers from slower production cycle times as it is necessary to spend relatively long time to collect and dry-up the unused $^{18}$O-enriched water before the formed $^{18}$F-Fluoride can be collected. Speeding production cycle at the expense of recovering all of the unused $^{18}$O-enriched water will increase the cost because of the unproductive loss of the start-up material. Recovering the unused $^{18}$O-enriched water is problematic, moreover, because of contaminating by-products generated as a result of the irradiation and chemical processing. This problem has led users to distill the water before reuse and, thus, implement complex distilling devices. These recovery problems complicate the system, and the production procedures, used in $^{18}$O-enriched water based $^{18}$F-Fluoride generation; the recovery problems also lower the product yield due in part to non-productive startup material loss and isotopic dilution.

Moreover, although proton beam currents of over 100 microamperes are presently available, $^{18}$O-enriched water based systems are not reliable when the proton beam current is greater than about 50 microamperes because water begins to vaporize and cavitate as the proton beam current is increased. The cavitation and vaporization of water interferes with the nuclear reaction, thus limiting the range of useful proton beam currents available to produce $^{18}$F-Fluoride from water. See, e.g., Heselius, Schlyer, and Wolf, Appl. Radiat. Isot. Vol. 40, No. 8, pp 663–669 (1989), incorporated herein by reference. Systems implementing approaches using $^{18}$O-enriched water to produce $^{18}$F-Fluoride are complex and difficult. For example, very recent publications (see, e.g., Helmeke, Harms, and Knapp, Appl. Radiat. Isot. 54, pp 753–759 (2001), incorporated herein by reference, hereinafter "Helmeke") show that it is necessary to use complicated proton beam sweeping mechanism, accompanied by the need to have bigger target windows, to increase the beam current handling capability a of $^{18}$O-enriched water system to 30 microamperes. In spite of the complicated irradiation system and target designs, the Helmeke approach has apparently allowed operation for only 1 hour a day.

Using water as the startup material, therefore, has also resulted in low $^{18}$F-Fluoride production yield at high cost.

Accordingly, a better, more efficient, and less costly method of producing $^{18}$F-Fluoride is needed.

SUMMARY OF THE INVENTION

The invention presents an approach that produces $^{18}$F-Fluoride by using a proton beam to irradiate $^{18}$Oxygen in gaseous form. The irradiated $^{18}$Oxygen is contained in a chamber that includes at least one component to which the produced $^{18}$F-Fluoride adheres. A solvent dissolves the produced $^{18}$F-Fluoride off of the at least one component while it is in the chamber. The solvent is then processed to obtain the $^{18}$F-Fluoride.

The inventive approach has an advantage of obtaining $^{18}$F-Fluoride by using a proton beam to irradiate $^{18}$Oxygen in gaseous form. The yield from the inventive approach is high because the nuclear reaction producing $^{18}$F-Fluoride from $^{18}$Oxygen in gaseous form has a relatively high cross section. The inventive approach also has an advantage of allowing the conservation of the unused $^{18}$Oxygen and its recycled use. The inventive approach appears not to be limited by the presently available proton beam currents; the inventive approach working at beam currents well over 100 microamperes. The inventive approach, therefore, permits using higher proton beam currents and, thus, further increases the $^{18}$F-Fluoride production yield. The inventive approach has a further advantage of producing pure $^{18}$F-Fluoride, without the other non-radioactive Fluorine isotopes (e.g., $^{19}$F).

BRIEF DESCRIPTION OF THE DRAWINGS

Other aspects and advantages of the present invention will become apparent upon reading the detailed description and accompanying drawings given hereinbelow, which are given by way of illustration only, and which are thus not limitative of the present invention, wherein.

DETAILED DESCRIPTION OF THE PREFERRED EMBODIMENTS

The invention presents an approach that produces $^{18}$F-Fluoride by using a proton beam to irradiate $^{18}$Oxygen in gaseous form. The irradiated $^{18}$Oxygen is contained in a chamber that includes at least one component to which the produced $^{18}$F-Fluoride adheres. A solvent dissolves the produced $^{18}$F-Fluoride off of the at least one component while the at least one component is in the chamber. The solvent is then processed to obtain the $^{18}$F-Fluoride.

Figure 1:
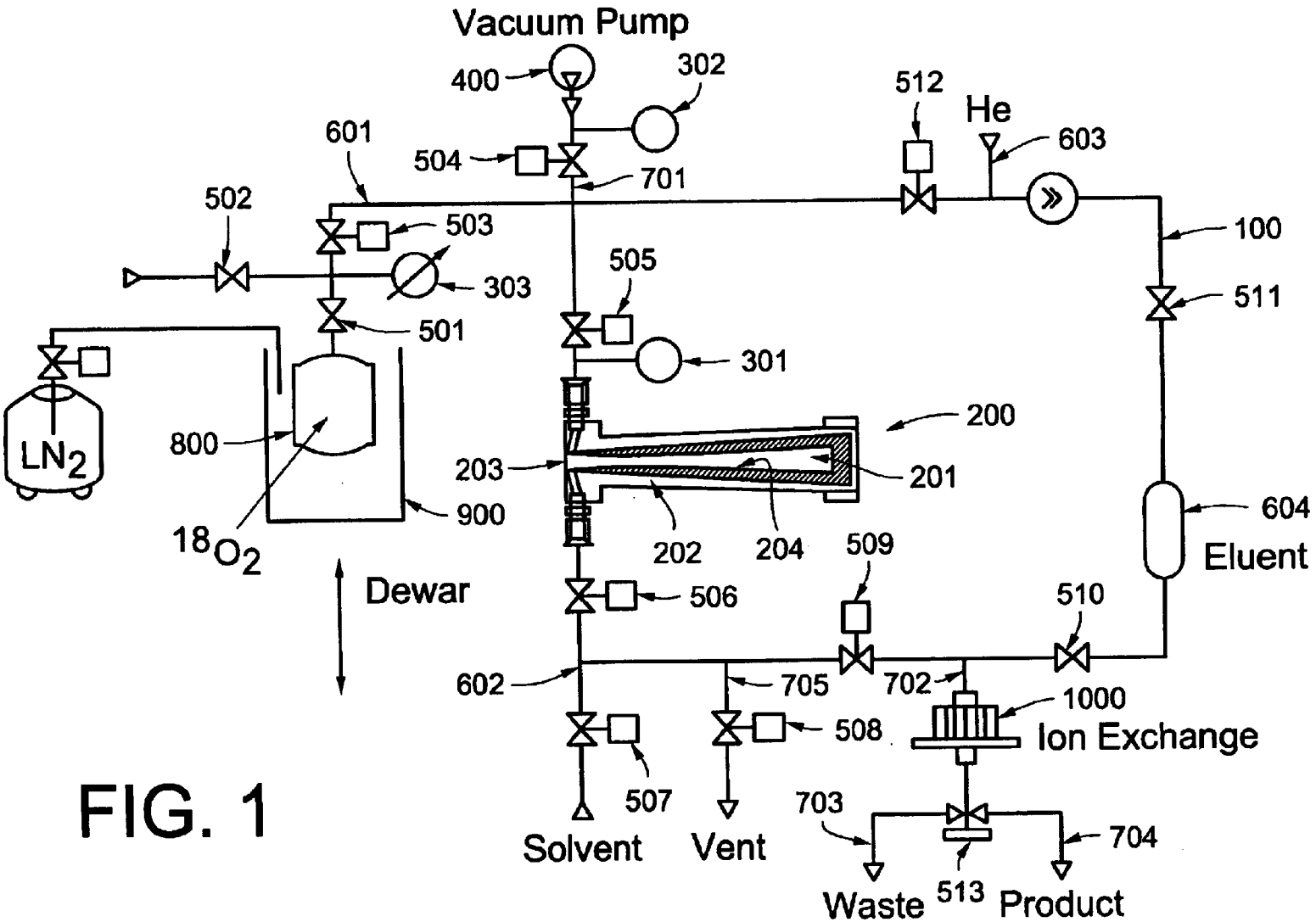
FIG. 1 is a general block diagram illustrating an exemplary embodiment of a system according to the present invention.

FIG. 1 is a diagram illustrating an exemplary embodiment of a system according to the inventive concept. As shown, the $^{18}$F-Fluoride forming system 1 includes a leak-tight looping tube 100 connecting a target chamber 200 to a vacuum pump 400 and to various inlets (601–604) and outlets (701–705). The looping tube 100 has at least valves (501–513) that separate various segments from each other. Preferably pressure gauges (301–303) are connected to the looping tube 100 to permit measuring the pressure within various segments of the looping tube 100 at different stages. In one implementation, stainless steel was used as the material for the looping tube 100. Alternative implementations use other suitable material.

In the embodiment of FIG. 1, the valves are implemented as manual valves (e.g., bellows or other suitable manual valves), as shown for valves 501, 502, 510, and 511, and automated valves (e.g., processor driven solenoid valves, or other suitable automated valves), as shown for valves 503, 504, 506, 507, 508, 509, 512, and 513. Other suitable combination can be chosen for the manual and automated valves. For example, all of the valves can be driven by processor(s) programmed to automate the production of $^{18}$F-Fluoride. Alternatively all of the valves can be manual.

The target chamber 200 includes an irradiation chamber volume 201, chamber walls 202 (that can include cooling device(s), or heating device(s) or both) that preferably are proton beam blocking, at least one chamber window 203 that transmits the proton beam into the chamber volume 201, and at least one chamber component 204. The $^{18}$Oxygen is exposed to the proton beam while being in the chamber volume 201. The chamber walls 202 and chamber window 203 retain the $^{18}$Oxygen in the chamber volume 201. The chamber window 203 transmits a large portion of the incident proton beams into the chamber volume 201. The produced $^{18}$F-Fluoride adheres to the chamber component 204. Preferably Havar (Cobolt-Nickel alloy) is used as the chamber window 203 because of its tensile strength (thus holding the $^{18}$O gas at high pressures within the chamber 200) and good proton beam transmission (thus transmitting the proton beam without significant loss). However, other suitable material, instead of Havar, can be used to form the chamber window. Preferably, the chamber volume 201 conically flares out and, thus, permits the efficient use of the scattered protons as they proceed into the chamber volume 201. However, other suitable shapes can be used for the chamber volume 201. The chamber volume 201 in exemplary embodiments used in runs demonstrating the inventive was about 15 milliliters—this excludes the connecting segments of the looping tube 100. The chamber volume 201 can be designed to have other suitable sizes.

In different non-limiting implementations, a cooling jacket (as a non-limiting example of cooling device) can form part of the chamber wall 202 (not shown in FIG. 1), heating tapes (as a non-limiting example of heating device) can form part of the chamber wall 202 (not shown in FIG. 1), or both. The temperature of the various parts of the chamber 200 can preferably be monitored by, for example, thermocouple(s) (not shown in FIG. 1). Using a cooling jacket allows the cooling of the chamber at various stages of producing $^{18}$F-Fluoride. Using heating tapes allows the heating of the chamber at the various stages of producing $^{18}$F-Fluoride. The cooling jacket, the heating tapes, or both, can be used to control the temperature of the chamber 200. Instead of a cooling jacket and heating tapes, other cooling and heating devices can be used. The cooling and heating devices can be located inside or outside the chamber wall 202. Using temperature measuring device(s) permits and augments the tracking and automation of the various stages of the $^{18}$F-Fluoride production.

On one side, the chamber 200 is connected to the looping tube 100 and a pressure transducer 301. This side of the looping tube has a valve 505 interrupting the continuation of the looping tube 100. On the other side, the chamber 200 is also connected to the looping tube 100. This other side of the looping tube has a valve 506 interrupting the continuation of the looping tube 100. After valve 505, the looping tube 100 has a vacuum pump outlet 701 allowing an access to vacuum pump 400 through valve 504 (with a pressure transducer 302 placed between the valve 504 and the vacuum pump 400). After valve 505, the looping tube 100 also has an $^{18}$Oxygen inlet 601 allowing access to $^{18}$Oxygen through valve 503. The continuation of the looping tube 100, after inlet 601 and outlet 701, is interrupted by valve 512, after which the looping tube has a Helium inlet 603 allowing access to Helium gas. The continuation of looping tube 100 after inlet 603 is interrupted by valve 511, after which the looping tube has an Eluent inlet 604. After the Eluent inlet 604, the continuation of the looping tube 100 is interrupted by valve 510, after which separator outlet 702 allows access from the looping tube 100 to a separator 1000. Separator 1000 leads to a bi-directional valve 513, which allows access either to waste outlet 703 or to product outlet 704. After outlet 702, the continuation of the looping tube 100 is interrupted by valve 509. Following valve 509, the looping tube 100 has both a vent outlet 705 leading to valve 508 and a solvent inlet 602 allowing a solvent into looping tube 100 through valve 507. After solvent inlet 602, the looping tube 100 connects to the valve 506.

The $^{18}$Oxygen inlet 601 connects (first through valve valves 503 and then through valve 501) to a container 800 for storing unused $^{18}$Oxygen. A pressure gauge 303 monitors the pressure at a region between valves 501 and 503. A valve 502 separates this region from a container of $^{18}$Oxygen to be used to top-off the $^{18}$Oxygen in the system whenever it is deemed necessary. Container 800 can be placed in a cryogenic cooler implemented as a liquid Nitrogen dewar 900 connected to a supply of liquid Nitrogen to selectively cool the container 800 to below the boiling point of $^{18}$Oxygen. The selective cooling can be achieved, for example, by moving the dewar up so as to have the container 800 be in the liquid Nitrogen. Instead of the liquid Nitrogen dewar 900 selectively cooling the container 800, in other implementations the container 800 can be enclosed in a refrigerator that can selectively lower the temperature of container 800 to below the boiling point of $^{18}$Oxygen, for example.

Figure 2:
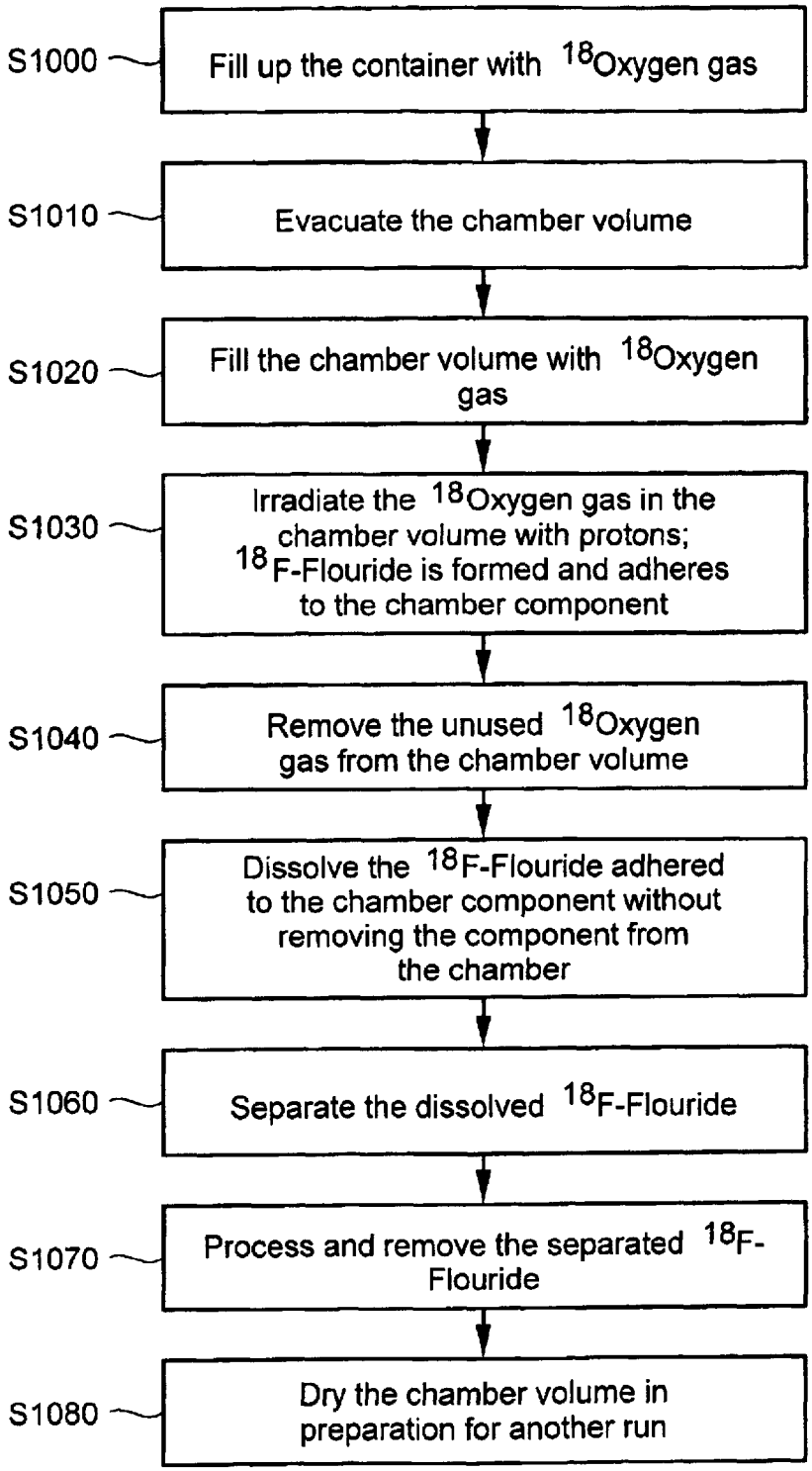
FIG. 2 is a general flow chart illustrating a method of using the embodiment of FIG. 1 to produce $^{18}$F-Fluoride from $^{18}$Oxygen gas.

A method of implementing the inventive concept is described hereinafter, by reference to FIG. 2, as an exemplary preferred method for using the embodiment of FIG. 1.

At the very beginning, valves 501–513 are closed. At the beginning of a very first run or after long-term storage and when it is unclear whether contaminant level has increased, it is desirable to pump out container 800 to reduce the number of contaminants that might exist otherwise. This can be achieved, for example, by opening valves 501–503–504 and exposing the container 800 to the vacuum pump 400. In step S1000 of FIG. 2, the container 800 is filled with $^{18}$Oxygen gas to a desired pressure. This can be achieved by closing valve 503 and opening valves 501 and 502 and filling the container 800 with $^{18}$Oxygen gas, for example, while the pressure is monitored by pressure gauge 303.

In step S1010, the chamber volume 201 is evacuated. This can be accomplished, for example, by opening valves 504 and 505 and exposing the chamber volume 201 and the connecting looping tube 100 to the vacuum pump 400. The vacuum pump can be implemented, for example, as a mechanical pump, diffusion pump, or both. The pressure gauge 302 can be used to keep track of the vacuum level in the chamber volume 201. During step S1010, valves 503–506–512 can be closed to efficiently pump on chamber volume 201. When the desired level of vacuum in chamber 201 is achieved, valve 504 can be closed thus isolating the vacuum pump 400 from the chamber volume 201. The desired level of vacuum in chamber volume 201 is preferably high enough so that the amount of contaminants is low compared to the amount of $^{18}$F-Fluoride formed per run. Step S1010 can be augmented by heating chamber 200 so as to speed up its pumping.

In step S1020, the chamber volume 201 is filled with $^{18}$Oxygen gas to a desired pressure. This can be accomplished, for example, by opening valves 501–503–505 and allowing the $^{18}$Oxygen gas to go from the container 800 to the chamber volume 201. Pressure gauges 301 or 303, or both, can be used to keep track of the pressure and, thus, the amount of $^{18}$Oxygen gas in chamber volume 201.

In step S1030, the $^{18}$Oxygen gas in chamber volume 201 is irradiated with a proton beam. This can be accomplished, for example, by closing valve 505 and directing the proton beam onto the chamber window 203. The chamber window 203 can be made of a thin foil material that transmits the proton beam while containing the $^{18}$Oxygen gas and the formed $^{18}$F-Fluoride. As the $^{18}$Oxygen gas is being irradiated by the proton beam, some of the $^{18}$Oxygen nuclei undergo a nuclear reaction and are converted into $^{18}$F-Fluoride. The nuclear reaction that occurs is:

$$^{18}\text{Oxygen}+p \rightarrow {}^{18}\text{F}+n.$$

The irradiation time can be calculated based on well-known equations relating the desired amount of $^{18}$F-Fluoride, the initial amount of $^{18}$Oxygen gas present, the proton beam current, the proton beam energy, the reaction cross-section, and the half-life of $^{18}$F-Fluoride. TABLE 1 shows the predicted yields for a proton beam current of 100 microamperes at different proton energies and for different irradiation times. TTY is an abbreviation for the yield when the target is thick enough to completely absorb the proton beam. TTY refers to "Thick Target Yield."

TABLE 1

| Ep(MeV) | TTY at Sat (Ci) | TTY with 2-Hour Irradiation (Ci) | TTY with 4-Hour Irradiation (Ci) |
|---|---|---|---|
| 12 | 21 | 10.5 | 15.8 |
| 15 | 25 | 12.5 | 18.8 |
| 20 | 30 | 15 | 22.5 |
| 30 | 46 | 23 | 34.5 |

TTY is an abbreviation for thick target yield, wherein the $^{18}$Oxygen gas being irradiated is thick enough—i.e., is at enough pressure—so that the entire transmitted proton beam is absorbed by the $^{18}$Oxygen. The yields are in curie. TTY at sat is the yield when the irradiation time is long enough for the yield to saturate—about 12 Hours for $^{18}$Oxygen gas.

Preferably the $^{18}$Oxygen gas is at high pressures: The higher the pressure the shorter the necessary length for the chamber volume 201 to have the $^{18}$Oxygen gas present a thick target to the proton beam. TABLE 2 shows the stopping power (in units of gm/cm$^2$) of Oxygen for various incident proton energies. The length of $^{18}$Oxygen gas (the gas being at a specific temperature and pressure) that is necessary to completely absorb a proton beam at a specific energy is given by the stopping power of Oxygen divided by the density of $^{18}$Oxygen gas (the density being at the specific temperature and pressure). Using this formula, a length of about 155 centimeters of $^{18}$Oxygen gas at STP (300K temperature and 1 atm pressure) is necessary to completely absorb a proton beam having energy of 12.5 MeV. By increasing the pressure to 20 atm, the necessary length at 300K becomes about 7.75 centimeters.

TABLE 2

| Proton Energy (MeV) | Proton Stopping Power For Oxygen gas (gm/cm$^2$) |
|---|---|
| 4.5 | 0.03738 |
| 5 | 0.04479 |
| 5.5 | 0.05278 |
| 6 | 0.06134 |
| 6.5 | 0.07047 |
| 7 | 0.08015 |
| 7.5 | 0.09039 |
| 8 | 0.10118 |
| 8.5 | 0.1125 |
| 9 | 0.12435 |
| 9.5 | 0.13674 |
| 10 | 0.14964 |
| 12.5 | 0.22181 |
| 15 | 0.30643 |
| 17.5 | 0.40308 |
| 20 | 0.51143 |
| 22.5 | 0.63119 |
| 25 | 0.7621 |
| 27.5 | 0.90392 |
| 30 | 1.0565 |
| 50 | 2.641 |
| 100 | 9.09 |

Consequently in one preferred implementation, the chamber 200 (along with its parts) is designed to withstand high pressures, especially since higher pressures become necessary as the chamber 200 and gas heat up due to the irradiation by the proton beam. In one exemplary implementation of the inventive concept to produce $^{18}$F-Fluoride from $^{18}$Oxygen gas, we have demonstrated the success of using Havar with thickness of 40 microns to contain $^{18}$Oxygen at fill pressure of 20 atm irradiated with 13 MeV proton beam (protons with 12.5 MeV transmitting into the chamber volume, 0.5 MeV being absorbed by the Havar chamber window) at a beam current of 20 microamperes. The exemplary implementation successfully contained the $^{18}$Oxygen gas during irradiation with the proton beam and, therefore, with the $^{18}$Oxygen gas having much higher temperatures (well over 100° C.) and pressures than the fill temperature and pressure before the irradiation. In another exemplary implementation, cooling jackets (lines) were used to remove heat from the chamber volume during irradiation. A preferred implementation would run the inventive concept at high pressures to have relatively short chamber length and thus simplify the requirements on the intensity of the incident proton beam. in alternative implementations, other suitable designs can be used to contain the $^{18}$Oxygen gas at desired pressures.

The $^{18}$F-Fluoride adheres to the chamber component 204 as it is formed. The material chosen for the at least one chamber component 204 preferably is one to which $^{18}$F-Fluoride adheres well. The material chosen for the chamber component 204 preferably is one of which the adhered $^{18}$F-Fluoride dissolves easily when exposed to the appropriate solvent. Such materials include, but are not limited to, stainless steel, glassy Carbon, Titanium, Silver, Gold-Plated metals (such as Nickel), Niobium, Havar, Aluminum, and Nickel-plated Aluminum. Periodic pre-fill treatment of the chamber component 204 can be used to enhance the adherence (and/or subsequent dissolving, see later step S1050) of $^{18}$F-Fluoride.

In step 1040, the unused portion of $^{18}$Oxygen is removed from the chamber volume 201. This can be accomplished, for example, by opening valves 501–503–505, with the container 800 cooled to below the boiling point of $^{18}$Oxygen. In this case, the unused portion of $^{18}$Oxygen is drawn into the container 800 and, thus, is available for use in the next run. This step allows for the efficient use of the starting material $^{18}$Oxygen. It is to be noted that the cooling of container 800 to below the boiling point of $^{18}$Oxygen can be performed as the chamber volume 201 is being irradiated during step S1030. Such an implementation of the inventive concept reduces the run time as different steps are performed, for example, in parallel with the different segments of the looping tube 100 being isolated from each other by the various valves. The pressure of the $^{18}$Oxygen gas can be monitored by pressure gauges 303 or 301, or both.

In step S1050, the formed $^{18}$F-Fluoride adhered to the chamber component 204 is preferably dissolved using a solvent without taking the chamber component 204 out of the chamber 200. This can be accomplished, for example, by opening valves 506–507, while valve 505 is closed, and allowing the solvent to be introduced to the chamber volume 201. The adhered $^{18}$F-Fluoride is preferably dissolved by and into the introduced solvent. Step S1050 can be augmented by heating chamber 200 so as to speed up the dissolving of the produced $^{18}$F-Fluoride. This procedure allows the solvent to be sucked into the vacuum existing in the chamber volume 201, thus aiding both in introducing the solvent and physically washing the chamber component 204. Alternatively, the solvent can also be introduced due to its own flow pressure.

The material used as a solvent preferably should easily remove (physically and/or chemically) the $^{18}$F-Fluoride adhered to the chamber component 204, yet preferably easily allow the uncontaminated separation of the dissolved $^{18}$F-Fluoride. It also preferably should not be corrosive to the system elements with which it comes into contact. Examples of such solvents include, but are not limited to, water in liquid and steam form, acids, and alcohols. $^{19}$Fluorine is preferably not the solvent—the resulting mixture would have $^{18}$F-$^{19}$F molecules that are not easily separated and would reduce, therefore, the yield of the produced ultimate $^{18}$F-Fluoride based compound.

TABLE 3 shows the various percentages of the produced $^{18}$F-Fluoride extracted using water at various temperatures. It is seen that a chamber component made from Stainless Steel yields 93.2% of the formed $^{18}$F-Fluoride in two washes using water at 80° C. Glassy Carbon, on the other hand, yields 98.3% of the formed $^{18}$F-Fluoride in a single wash with water at 80° C. The wash time was on the order of ten seconds. Using water at higher temperatures is expected to improve the yield per wash. Steam is expected to perform at least as well as water, if not better, in dissolving the formed $^{18}$F-Fluoride. Other solvents may be used instead of water, keeping in mind the objective of rapidly dissolving the formed $^{18}$F-Fluoride and the objective of not diluting the Fluorine based ultimate compound.

TABLE 3

| Material of Chamber Component | % Recovered in 1st Wash | % Recovered in 2nd Wash | Total % Recovered in 2 Washes | Wash Temp ° C. |
|---|---|---|---|---|
| Ni-plated Al | 66.4 | 7.4 | 73.8 | 80 |
| Ni-plated Al | 42.9 | 6.8 | 49.7 | 60 |
| Ni-plated Al | 34.4 | 4.4 | 38.8 | 20 |
| Stainless Steel | 80.6 | 12.6 | 93.2 | 80 |
| Aluminum | 5.6 | 1.8 | 7.5 | 80 |
| Glassy Carbon | 64.1 | 22.9 | 87.0 | 20 |
| Glassy Carbon | 98.3 | N.A. | 98.3 | 80 |

In step 1060, the formed $^{18}$F-Fluoride is separated from the solvent. This can be accomplished, for example, by closing valve 507 and opening valves 512–505–506–509 and having bidirectional valve 513 point to waste outlet 703. This allows the Helium to push the solvent along with the dissolved $^{18}$F-Fluoride out of the chamber volume 201 and towards the separator 1000. The separator 1000 separates the formed $^{18}$F-Fluoride from the solvent, retains the formed $^{18}$F-Fluoride, and allows the solvent to proceed to waste outlet 703.

The separator 1000 can be implemented using various approaches. One preferred implementation for the separator 1000 is to use an Ion Exchange Column that is anion attractive (the formed $^{18}$F-Fluoride being an anion) and that separates the $^{18}$F-Fluoride from the solvent. For example, Dowex IX-10, 200–400 mesh commercial resin, or Toray TIN-200 commercial resin, both of which are anion exchange resins (from BIO-RAD), of Hercules, Calif.), can be used as the separator. Yet another implementation is to use a separator having specific strong affinity to the formed $^{18}$F-Fluoride such as a QMA SEP-PAK, (an ion retardation column manufactured by Waters of Milford, Mass.) for example. Such implementations for the separator 1000 preferentially separate and retain $^{18}$F-Fluoride but do not retain the radioactive metallic byproducts (which are cations) from the solvent, thus retaining a high purity for the formed radioactive $^{18}$F-Fluoride. Another preferred implementation for the separator 1000 is to use a filter retaining the formed $^{18}$F-Fluoride.

In step 1070, the separated $^{18}$F-Fluoride is processed from the separator 1000. This can be accomplished, for example, by closing valves 509–512 and opening valves 510–511 and having valve 513 point to the product outlet 704. The Helium then directs the Eluent towards the separator 1000; with the Eluent processing the separated $^{18}$F-Fluoride out of the separator 1000 and carrying it to the product outlet 704. The Eluent used must have an affinity to the separated $^{18}$F-Fluoride that is stronger than the affinity of the separator 1000. Various chemicals may be used as the Eluent including, but not limited to various kinds of bicarbonates. Non-limiting examples of bicarbonates that can be used as the Eluent are Sodium-Bicarbonate, Potassium-Bicarbonate, and Tetrabutyl-Ammonium-Bicarbonate. Other anionic Eluents can be used in addition to, or instead of, Bicarbonates. A user then obtains the processed $^{18}$F-Fluoride through product outlet 704 and can use it in nucleophilic reactions, for example.

In step 1080, the chamber volume 201 is dried in preparation for another run of forming $^{18}$F-Fluoride. This can be accomplished, for example, by closing valve 511 and opening valves 512–505–506–508. The Helium then is allowed to flow through the chamber volume 201 towards and out of the vent outlet 705. Pressure gauge 301 can be used to monitor the drying of the chamber volume 201. Alternatively, a humidity monitor integrated with the pressure gauge 301 can be used to track the drying of the chamber volume 201. Step S1080 can be augmented by heating chamber 200 so as to speed up its drying.

It is to be noted that steps S1070 and S1080 can be overlapped in time. This can be accomplished, for example, by having valves 512–505–506–508 open while valves 511–510 are open and while valve 509 is closed. This allows the Helium to dry the chamber volume 201 while the Eluent is being directed through and out of the separator 1000 and product outlet 704, without pushing humidity towards the separator 702 or pushing the Eluent towards the vent outlet 705. It is also to be noted that although Helium has been described as the gas used in directing the solvents and Eluents and drying the chamber volume 201, the inventive concept can be practiced using any other gas that does not react with the formed $^{18}$F-Fluoride, the solvent, the Eluent, or with materials forming the system (including the pressure gauges, the valves, the chamber, and the tubing). For example, Nitrogen or Argon can be used instead of Helium.

After drying the chamber volume 201 from solvent remnants, the system is ready for another run for producing a new batch of $^{18}$F-Fluoride. The amount of $^{18}$Oxygen in container 800 can be monitored to determine whether topping-off is necessary. The overall process can then be repeated starting with step S1010.

Demonstration runs of the inventive concept have consistently yielded at least about 70% of the theoretically obtainable $^{18}$F-Fluoride from $^{18}$O gas. The setup had a chamber volume of about 15 milliliters, the $^{18}$Oxygen gas was filled to about pressure of 20 atmospheres, the proton beam was 13 MeV having beam current of 20 microamperes, the solvent was de-ionized with volume of 100 milliliters and a QMA separator was eluted with 2×2 milliliters of Bicarbonate solution. Such a result is especially important because $^{18}$Oxygen in gaseous form has 14–18% better yield than $^{18}$O-enriched water because the Hydrogen ions in the $^{18}$O-enriched water reduce the exposure of the $^{18}$Oxygen to the proton beam. This yield difference increases with decreasing proton energy; the yield difference being 16%, 15.2%, 14.75%, and 14.3% at 15, 30, 50, and 100 MeV, respectively. Consequently, the inventive concept produces significantly greater overall yield of $^{18}$F-Fluoride than can be produced by $^{18}$O-enriched water based systems. For example, running a simple (non-sweeping beam) system implementing the inventive concept at a proton current beam of 100 microamperes and energy of 15 MeV will produce about 53% greater overall yield than the complicated (sweeping beam and bigger target window) system of Helmeke running at its apparent maximum of 30 microamperes.

The inventive concept can be implemented with a modification using separate chemically inert gas inlets, instead of one inlet, to perform various steps in parallel. The inventive concept can also be implemented using a valve to separate the Eluent inlet from the looping tube 100. The looping tube 100 can be formed in different shapes including, but not limited to, circular and folding to reduce the size of the system. Cooling and/or heating devices can be used to control the temperature of the material transmitted by the looping tube 100, for example by surrounding at least a portion of the looping tube 100 with cooling and/or heating jackets. The temperature of the looping tube 100 can be monitored by thermocouples, for example, to better control the temperature of the transmitted material. Instead of one looping tube, parallel looping tubes can be used to increase the surface area and thus better enable heating and/or cooling the transmitted different material (gas/Eluent/solvent) by cooling and/or heating devices surrounding the looping tube. The chamber, and its different parts, can be formed from various different suitable designs and materials: This can be done to permit increasing the incident proton beam currents, for example.

Although the present invention has been described in considerable detail with reference to certain exemplary embodiments, it should be apparent that various modifications and applications of the present invention may be realized without departing from the scope and spirit of the invention. All such variations and modifications as would be obvious to one skilled in the art are intended to be included within the scope of the claims presented herein.

What is claimed is:

1. A method for preparing $^{18}$F-Fluoride from $^{18}$Oxygen, the method comprising the steps:

obtaining molecules of $^{18}$Oxygen in gaseous form in a chamber that includes at least one component to which $^{18}$F-Fluoride adheres;

irradiating the $^{18}$Oxygen gas in the chamber by a proton beam through a chamber window, a portion of the proton beam passing through the chamber window and reaching the $^{18}$Oxygen gas within the chamber having a beam current of 100 $\mu$A or more and converting a portion of the $^{18}$Oxygen into $^{18}$F-Fluoride, the converted $^{18}$F-Fluoride adhering to the at least one component; and exposing the at least one component to a solvent within the chamber, the solvent dissolving the $^{18}$F-Fluoride adhered to the at least one component while substantially maintaining a constant orientation between the chamber window and the at least one component during the irradiating and exposing steps.

2. The method for preparing $^{18}$F-Fluoride according to claim 1, wherein the solvent is water.

3. The method for preparing $^{18}$F-Fluoride according to claim 2, wherein the solvent is water at temperature equal to or greater than 80° C.

4. The method for preparing $^{18}$F-Fluoride according to claim 2, wherein the solvent is steam.

5. The method for preparing $^{18}$F-Fluoride according to claim 1, further comprising removing the solvent from the chamber through a separator that retains the dissolved $^{18}$F-Fluoride.

6. The method for preparing $^{18}$F-Fluoride according to claim 1, further comprising removing the remaining portion of the $^{18}$Oxygen gas from the chamber.

7. The method for preparing $^{18}$F-Fluoride according to claim 1, further comprising separating the dissolved $^{18}$F-Fluoride from the solvent using a separator having high affinity to $^{18}$F-Fluoride.

8. The method for preparing $^{18}$F-Fluoride according to claim 1, further comprising separating the dissolved $^{18}$F-Fluoride from the solvent using an anion attracting ion exchange column.

9. The method for preparing $^{18}$F-Fluoride according to claim 8, further comprising processing the separated $^{18}$F-Fluoride.

10. The method for preparing $^{18}$F-Fluoride according to claim 8, further comprising drying the chamber.

11. The method of claim 1, in which the proton beam energy is at least 15 MeV.

12. The method of claim 1, in which the at least one component to which $^{18}$F-Fluoride adheres has a surface of niobium, titanium, gold, nickel, stainless steel, or glassy carbon.

13. The method of claim 12, in which the at least one component to which $^{18}$F-Fluoride adheres has a surface of titanium, gold, nickel, stainless steel, or glassy carbon.

14. The method of claim 13, in which the at least one component to which $^{18}$F-Fluoride adheres has a surface of nickel, stainless steel, or glassy carbon.

15. A method for preparing $^{18}$F-Fluoride from $^{18}$Oxygen the method comprising the steps:

placing molecules of $^{18}$Oxygen in gaseous form in a chamber that includes at least one component having a surface of nickel, stainless steel, or glassy carbon, to which $^{18}$F-Fluoride adheres;

irradiating the $^{18}$Oxygen gas in the chamber by passing a proton beam through a chamber window, thus converting a portion of the $^{18}$Oxygen into $^{18}$F-Fluoride, wherein the converted $^{18}$F-Fluoride preferentially adheres to the at least one component; and exposing the at least one component to a solvent within the chamber while substantially maintaining a constant orientation between the chamber window and the at least one component during the irradiating and exposing steps, the solvent dissolving the $^{18}$F-Fluoride adhered to the at least one component.

16. A method for preparing $^{18}$F-Fluoride from $^{18}$Oxygen according to claim 15, wherein:

a majority of the converted $^{18}$F-Fluoride adheres to the at least one component.

17. A method for preparing $^{18}$F-Fluoride from $^{18}$Oxygen the method comprising the steps:

obtaining molecules of $^{18}$Oxygen in gaseous form in a chamber that includes at least one component to which $^{18}$F-Fluoride adheres;

irradiating the $^{18}$Oxygen gas in the chamber by passing a proton beam through a chamber window, a portion of the proton beam reaching the $^{18}$Oxygen gas having a beam energy of at least 17.5 MeV, thus converting a portion of the $^{18}$Oxygen into $^{18}$F-Fluoride, the converted $^{18}$F-Fluoride adhering to the at least one component; and exposing the at least one component to a solvent within the chamber while substantially maintaining a constant orientation between the chamber window and the at least one component during the irradiating and exposing steps, the solvent dissolving the $^{18}$F-Fluoride adhered to the at least one component.

18. The method of claim 17, in which the portion of the proton beam reaching the $^{18}$Oxygen gas has a beam current of at least 20 $\mu$A.

19. A method for preparing $^{18}$F-Fluoride from $^{18}$Oxygen, the method comprising the steps:

obtaining molecules of $^{18}$Oxygen in gaseous form in a chamber that includes at least one component to which $^{18}$F-Fluoride adheres;

irradiating the $^{18}$Oxygen gas in the chamber by passing a proton beam through a chamber window, a portion of the proton beam reaching the $^{18}$Oxygen gas having a beam power of at least 1.0 kilowatt, thus converting a portion of the $^{18}$Oxygen into $^{18}$F-Fluoride, the converted $^{18}$F-Fluoride adhering to the at least one component; and exposing the at least one component to a solvent within the chamber while substantially maintaining a constant orientation between the chamber window and the at least one component during the irradiating and exposing steps, the solvent dissolving the $^{18}$F-Fluoride adhered to the at least one component.

* * * * *